United States Patent [19]

Dounchis

[11] 3,931,023

[45] Jan. 6, 1976

[54] TRIARYL PHOSPHATE ESTER FUNCTIONAL FLUIDS

[75] Inventor: Harry Dounchis, Trenton, N.J.

[73] Assignee: FMC Corporation, Philadelphia, Pa.

[22] Filed: July 22, 1974

[21] Appl. No.: 490,767

[52] U.S. Cl. ..... 252/49.8; 252/49.6; 252/50; 252/51.5 A; 252/52 A; 252/78; 252/400 A

[51] Int. Cl.[2]..... C10M 1/10; C10M 3/02; C10M 5/02; C10M 7/02

[58] Field of Search ..... 252/49.8, 78, 400 A, 50, 252/51.5 A, 49.6, 52 A

[56] References Cited

UNITED STATES PATENTS 3,071,549 1/1963 Stark..... 252/49.8

3,576,923 4/1971 Randell et al..... 260/966

*Primary Examiner*—Delbert E. Gantz
*Assistant Examiner*—I. Vaughn

[57] ABSTRACT

There are disclosed triaryl phosphate ester functional fluids, such as lubricants and hydraulic fluids, which contain as the oxidatively stable component, a mixed tertiary-butylphenyl/phenyl phosphate containing about 15 to 60 percent by weight mono- and di-t-butylphenyl radicals.

14 Claims, No Drawings

TRIARYL PHOSPHATE ESTER FUNCTIONAL FLUIDS

This invention relates to improved synthetic phosphate ester functional fluids particularly suitable for use as lubricants, hydraulic fluids and the like. More particularly, the invention relates to triaryl phosphate ester compositions derived from mixtures of tertiary-butylphenols and phenol which exhibit a high degree of resistance to oxidative and thermal degradation.

Triaryl phosphates and mixed alkylphenyl/phenyl phosphates are known and are described, for example, in U.S. Pat. No. 3,576,923 issued Apr. 27, 1971 to Randell et al. Synthetic functional fluids and lubricants containing alkylphenyl/phenyl phosphates and triaryl phosphates with various types may be found in U.S. Pat. Nos. 2,938,871 issued May21, 1960 to Matuszak; 3,012,057 issued Dec. 5, 1961 to Fierce et al.; 3,071,549 issued Jan. 1, 1963 to Stark; 3,468,802 issued Sept. 23, 1969 to Nail; 3,723,315 issued Mar. 27, 1973 to Sullivan and 3,780,145 issued Dec. 18, 1973 to Malec.

The present invention is based on the discovery that phosphorylated mixtures of tertiary-butylphenols and phenol provide triaryl phosphate ester functional fluids which exhibit heretofore unrecognized thermal and oxidation stability which renders such triaryl phosphate esters particularly suitable for use in the formulation of functional fluids such as lubricants, particularly turbine lubricants, hydraulic fluids and the like where extreme conditions such as high temperatures or extended periods of use require fluids of unusual stability properties.

In accordance with the present invention, there are provided functional fluid compositions comprising 95 to 99.99 percent by weight of a mixed tertiary-butylphenyl/phenyl phosphate containing between about 15 to 60 percent, preferably 30 to 50 percent by weight mono- and di-t-butylphenyl radicals, as the base stock, and in admixture with the base stock very minor amounts, about 0.01 to 5 percent by weight of lubricant additives such as rust inhibitors, corrosion inhibitors, anti-foam agents, antiwear agents, cavitation inhibitors, and similar special purpose additives.

Rust and corrosion inhibitors commonly employed are compounds such as benzothiazole, benzotriazole, tri-ethanolamine, phenothiazine, trialkyl phosphates, such as mixed mono- and di-alkyl phosphates, N-acyl sarcosines, the acyl radical having 10 to 18 carbon atoms, propyl gallate, succinic acid and alkyl succinic acids. Other additives to inhibit foaming and cavitation included organo-silicone compounds, dialkyl carboxylic acid esters, such as diethyl succinate or dioctyl sebacate, or lower alkanes such as butane, propane and isomers thereof.

Functional fluids formulated in accordance with the present invention which contain a mixed tertiary butylphenyl/phenyl phosphate as the base stock with small proportions of the specialty additives described above are particularly suitable for high temperature use applications, since they exhibit a kinematic viscosity stability of ±5 percent when subjected to temperatures within the range of 175°C to 220°C for a period of 72 hours.

Particularly preferred embodiments are functional fluid formulations which consist essentially of a mixed t-butylphenyl/phenyl phosphate, the formulation containing 0.01 to 0.1 percent by weight of a member selected from the group of additives consisting of benzotriazole, N-oleoyl sarcosine, or a mixed mono- and dialkyl phosphate of the formula $RH_2PO_4$ and $R_2HPO_4$, the alkyl being $C_8$–$C_{12}$ and mixtures of these additives. These formulated compositions may also contain very small proportions, that is, about 0.001 percent, of a silicone anti-foam agent, such as a dimethyl silicone polymer. These formulated compositions are highly significant in that they offer the desirable combined properties of oxidative stability at elevated temperatures, thereby eliminating the need for antioxidant additives, and excellent corrosion and rust resistance, which enable functional fluids prepared in accordance with the present invention to meet the most demanding commercial specifications. So far as applicant is aware, there are no commercially available triaryl phosphate ester-based formulations which offer these combined properties. The remarkable stability of the compositions of the present invention at high temperatures is shown by their relatively unchanged viscosity and acid number when compared with heretofore available phosphate ester fluids.

A further embodiment of the present invention resides in thermally and oxidatively stable mixed functional fluids comprising 10 to 90 percent by weight of a mixed tertiary-butylphenyl/phenyl phosphate as hereinbefore described and 90 to 10 percent by weight of another fluid composition useful in formulating functional fluids. Thus, mixtures may be prepared with other functional fluids such as the synthetic or natural hydrocarbon oils, halogenated aromatic hydrocarbons, organic esters such as the alkanoic acid esters of organic polyhydroxy compounds such as pentaerythritol, trimethylolethane and trimethylolpropane, neopentyl glycol esters and the like, the alkanoic acids generally having from about 5 to 10 carbon atoms. Other functional fluids useful for formulating mixtures include the alkoxypolysiloxane and organo polysiloxane fluids such as dimethylpolysiloxane, methylphenylpolysiloxane, dimethyldiphenylpolysiloxanes, methyl alkyl silicone fluids, siloxane esters, polyphenyl ethers such as bis(m-phenoxyphenyl) ether, diphenoxy biphenyl isomers, alkoxy aromatic ethers, polyglycols such as polyalkylene glycols and polyoxyalkylene glycols, silicate esters, such as tetraalkyl, tetraryl and mixed alkylaryl orthosilicate esters. Particularly useful are oxidatively stable functional fluids compositions comprising 40 to 60 percent by weight of a mixed tertiary-butylphenyl/phenyl phosphate ester and 60 to 40 percent of a functional fluid selected from the group consisting of petroleum hydrocarbons of lubricating viscosity, a silicone functional fluid or alkanoic acid ester functional fluid, particularly a pentaerythritol ester.

The compositions of the present invention because of their excellent stability at very high temperatures, are particularly suitable for use in applications wherein high use temperatures are routinely encountered such as in the lubrication of gas turbines, particularly aero gas turbines, power generating gas turbines, steam turbines and the like. Fluids formulated in accordance with the present invention containing the mixed t-butylphenyl/phenyl phosphate esters described herein are also especially suitable for use as hydraulic fluids, capacitator and transformer oils as well as for heat transfer fluids. In these applications, a high degree of oxidative stability is of importance. Since antioxidant additives are not present, filtration of such fluids in the course of their use for the purpose of removing impurities will not diminish their stability.

A further embodiment of the present invention resides in a method of lubricating metallic surfaces at elevated temperatures, that is, in excess of about 50°C, comprising applying to said metallic surfaces an oxidatively stable phosphate triester said triester being a mixed t-butylphenyl/phenyl phosphate containing about 15 to 60 percent of mono- and di-t-butylphenyl radicals. Mixed t-butylphenyl/phenyl phosphates are particularly suitable for lubrication at high temperatures of metals present in the gears and bearings of a gas turbine such as copper, magnesium, iron, steel, aluminum, silver and lead. Temperatures in the range of 50°C to 400°C are commonplace in the operation of steam and gas turbines. The compositions of the present invention are particularly suitable for lubricating at temperatures in excess of about 175°C, because of their resistance to thermal degradation at these high temperatures.

The tertiary-butylphenyl/phenyl phosphates described herein also exhibit anti-wear properties. This property, in combination with their unusual degree of thermal stability, renders these materials particularly suitable for use in very minor amounts as additives for other functional fluids. As special purpose additives, they may be present in amounts between about 0.1 to 5 percent by weight. Thus, they may be employed as additives for functional fluids such as the polyol alkanoic acid esters, the silicone fluids as well as natural and synthetic hydrocarbon oils. They function as suitable anti-wear or extreme pressure additives and offer the additional advantage of superior resistance to thermal and oxidative deterioration.

The mixed t-butylphenyl/phenyl phosphate esters may be prepared by any suitable conventional technique such as by phosphorylation of an isobutylene-phenol alkylation mixture as disclosed, for example, in U.S. Pat. No. 3,576,923 which results in a complex mixture of mono- and di-t-butylphenols and phenol. Alternatively, appropriate mixtures of a t-butylphenol and phenol may be phosphorylated to produce the mixed t-butylphenyl/phenyl phosphate for use in accordance with the present invention.

The invention is further illustrated by the following examples which should not be considered as limitative of its scope. Temperatures are in degrees centigrade and percentages are by weight, unless otherwise indicated.

EXAMPLE I

The preparation of mixed t-butylphenyl/phenyl phosphate ester fluids is set forth in the following Examples 1 (a) to 1 (f). Properties of the various mixed t-butylphenyl/phenyl phosphate triesters are set forth in Table 1.

a. Into a stirred suspension of dried acid activated clay catalyst, sold as "Super Filtrol," (75 g, 2.0 percent by wt.) in phenol (3,765 g, 40 moles) was bubbled isobutylene (664.4 g, 11.8 moles) at 80°. Aluminum chloride (44 g, 1.0 percent by wt.) was added to the stirred suspension and the temperature was increased to 118° when the addition of phosphorus oxychloride (2,037 g, 13.0) moles began. The addition required 3.0 hours as the temperature was gradually increased to 220° where it was maintained for an additional 3.0 hours after the addition. The hydrogen chloride which evolved was swept out of the system with nitrogen into a scrubber.

Without filtering the catalysts, the product was flash distilled out of the reactor. The main fraction (4,062 g, 81%) boiled 180° to 230° at 0.4 torr. Redistillation through a 12 inch Goodloe column in the presence of 1.0 percent by wt. of sodium carbonate provided 3,990 grams (80 percent) of t-butylated phenyl/phenyl phosphates which boiled at 195° to 235° at 0.4 torr.

b. Using a process analogous to that in Example 1 (a), phenol (4,220 g, 44.8 moles) and isobutylene (469 g, 8.38 moles) were reacted in the presence of Super Filtrol. The phosphorylation was similar except anhydrous magnesium chloride (1.0 percent by wt.) was used. Distillation afforded 4,714 grams (88 percent) of t-butylated phenyl/phenyl phosphates which boiled at 195° to 220° at 0.25 torr.

c. Using a process analogous to that in Example 1 (a), phenol (3,764 g, 40 moles) was reacted with 941 grams (16.8 moles) of isobutylene. Phosphorylation and distillation afforded 4,856 grams (92 percent) of product which boiled at 210° to 240° at 0.15 torr.

d. Phenol (2,069 g, 22.0 moles) and isobutylene (454 g, 8.1 moles) were reacted and phosphorylated in a manner as described in Example 1 (a).

e. To a stirred solution (70°) of phenol (2,760 g, 29.6 moles) and p-t-butylphenol (1,800 g, 12.0 moles) was added 2,195 grams (14.3 moles) of $POCl_3$ in the presence of $MgCl_2$ (30 g, 0.5 percent by wt.). The remainder of the preparation was carried out in an analogous manner as described in Example 1 (a) to yield 5,140 grams (94 percent) of triester.

f. An alkylate prepared in an analogous manner to that described in Example 1 (a) was transalkylated by heating in a sealed system at 130° for 3.5 hours in the presence of 2.0 percent by wt. of Super Filtrol catalyst. Comparative analyses before and after this treatment are given below.

| | Phenol | Phenols - % by weight ortho | meta/para | 2,4-di |
|---|---|---|---|---|
| Alkylate of Ex. 1(a) | 59.80 | 8.84 | 25.21 | 6.07 |
| Transalkylated product | 55.80 | 2.91 | 40.8 | 0.39 |

Phosphorylation of the transalkylated product as described in Example 1 (a) produced 2,870 grams (90%) which boiled at 190° to 240° at 0.1 torr.

g. Alkylate from Example 1 (d) was transalkylated in a similar manner to Example 1 (e). Comparative analyses of the phenol distribution are again set forth:

| | Phenol | Phenols - % by weight ortho | meta/para | 2,4-di |
|---|---|---|---|---|
| Alkylate of Ex. 1(d) | 52.80 | 7.09 | 35.50 | 4.47 |
| Transalkylated product | 47.40 | 3.21 | 48.60 | 0.68 |

Phosphorylation and distillation afforded a phosphate triester product.

EXAMPLE II

The mixed tertiary butyl substituted triaryl phosphates prepared in Example 1 were evaluated for oxidative stability and corrosivity according to Federal Test Method Standard No. 791B Method 5308.6 "Corrosiveness and Oxidation Stability of Light Oils." Comparisons of the products of this invention with other commercial triaryl phosphates via this procedure were made. The results of these evaluations are presented in Table 2. The remarkable oxidative stability of the mixed tertiary butyl substituted triaryl phosphates is manifestly apparent when comparing acid number changes and viscosity differences with other triaryl phosphates. The products were evaluated before and after exposure to 175°C for 72 hours.

EXAMPLE III

Evaluations of the oxidative stability of the mixed tertiary butyl substituted triaryl phosphates were made according to the MIL-L-23699B 3.3.10 military specification at 204°C and 218°C after 72 hours, with data for 204°C reported in Table 3 and data for 218°C reported in Table 4. The viscosity stability at very high temperatures is readily apparent.

EXAMPLE IV

The superior oxidative stability of the compounds of this invention is not diminished by treatment with additives known in the art to inhibit metal corrosion, rusting and foaming. Results of evaluations of mixed tertiary butyl substituted triaryl phosphates formulated with a copper passivator (benzotriazole), rust inhibitors (Sarkosyl O and Ortholeum 162), a dimethyl silicone antifoam agent (Dow-Corning "Compound A"), antioxidants and acid sumps (Kronox S) are summarized in Tables 5 and 6. It is readily apparent from these results that the extraordinary thermal and oxidative characteristics of the compositions are maintained and their utility enhanced as indicated by the ASTM D-665 rust test.

EXAMPLE V

This example demonstrates the superior oxidative stability of mixtures of the phosphate esters of this invention with alkanoic acid esters. The table below compares the stability of an unstabilized 65/35 vol./vol. blend of phosphate ester of Example 1 (a) and "Natcol 1570" with a similar 65/35 mixture of tricresyl phosphate (TCP)/Natcol 1570. Natcol 1570 is a commercially available pentaerythritol alkanoic acid ($C_5$–$C_{10}$ acids) ester. It is clearly evident that by comparison of the change in viscosity and acid number the composition of this invention is significantly more stable than the one based on TCP. The data are set forth below. Corrosion results are also shown.

| Federal Test Method Standard No. 791B, Method 5308.6 at 175°C for 72 Hours | Ex. 1(a)/Natcol 1570 (65/35) | TCP/Natcol 1570 (65/35) |
|---|---|---|
| ΔTAN* (mg/KOH/g) | 6.60 | 11.9 |
| % Viscosity Change (cs at 100°F) | 29.0 | 54.0 |
| Wt. Change (mg/cm²) | | |
| Cu | −0.67 | −0.18 |
| Steel | +0.01 | +0.01 |
| Mg | −0.01 | −0.01 |
| Al | 0.00 | 0.00 |
| Ag | −0.06 | −0.04 |

*ΔTAN = Change in total acid number.

TABLE I

| | 1(a) | 1(b) | 1(c) | 1(d) | 1(e) | 1(f) | 1(g) |
|---|---|---|---|---|---|---|---|
| $N^{25}$ Refractive index | 1.5520 | 1.5582 | 1.5452 | 1.5487 | 1.5517 | 1.5506 | 1.5480 |
| Chloride, ppm | 1.0 | 1.0 | 5.0 | 1.0 | 5.0 | 0.5 | 3.0 |
| Color, pt-Co. | 15 | 20 | 45 | 10 | 10–15 | 50 | 30 |
| Acid No. (mmKOH/g) | 0.24 | 0.15 | 0.17 | 0.03 | 0.08 | 0.08 | 0.03 |
| Moisture, % | 0.032 | 0.019 | 0.031 | 0.003 | 0.016 | 0.04 | 0.005 |
| Viscosity, cs at 100°F | 33.71 | 21.4 | 77.15 | 49.34 | 38.3 | 41.9 | 57.64 |
| Sp. Gr. at 27/27°C | 1.17 | 1.20 | 1.13 | 1.15 | 1.16 | 1.16 | 1.16 |
| Free Phenol, % | 0.02 | 0.008 | 0.01 | 0.028 | — | 0.028 | 0.024 |

TABLE 2

| | 72 Hours at 175°C | | | | | | | | | | | |
|---|---|---|---|---|---|---|---|---|---|---|---|---|
| | KINEMATIC VISCOSITY (100°F) | | | ACID NUMBER (mg KOH/g) | | | APPEAR- | WEIGHT CHANGE OF METALS (mg/cm²) | | | | |
| COMPOSITION | INITIAL | FINAL | % CHANGE | INITIAL | FINAL | FTAN* | ANCE* | Cu | Steel | Mg | Al | Ag |
| 1.Ex. 1(b) | 21.17 | 21.51 | +1.61 | 0.05 | 0.25 | 0.20 | A | −0.68 | −0.01 | 0.00 | −0.01 | −0.02 |
| 2.Ex. 1(a) | 31.99 | 32.15 | +0.50 | 0.18 | 0.18 | 0.00 | A | −0.33 | 0.00 | −0.04 | 0.00 | 0.00 |
| 3.Ex. 1(d) | 48.08 | 49.53 | +3.02 | 0.06 | 0.38 | 0.32 | B | −1.22 | +0.01 | +0.01 | +0.01 | +0.01 |
| 4.Ex. 1(c) | 76.73 | 78.27 | +2.01 | 0.03 | 0.25 | 0.22 | A | −0.41 | −0.07 | −0.02 | +0.01 | 0.00 |
| 5. IPP* | 32.04 | 86.54 | +101.70 | 0.24 | 26.70 | 26.46 | C | −0.31 | 0.00 | +0.04 | +0.01 | −0.18 |
| 6. TCP* | 27.53 | 31.92 | +15.95 | 0.30 | 5.05 | 4.75 | B | −0.24 | +0.02 | +0.02 | +0.02 | −0.01 |
| 7. TXP* | 43.11 | 63.40 | +47.06 | 0.00 | 7.80 | 7.80 | B | −0.15 | +0.02 | +0.04 | +0.03 | −0.07 |
| 8. CDP* | 18.79 | 19.60 | +4.31 | 0.05 | 1.02 | 0.97 | B | −0.69 | +0.01 | +0.02 | +0.02 | −0.03 |

IPP = Mixed isopropylphenyl/phenyl phosphate; TCP-Tricresyl phosphate; TXP=Trixylyl phosphate; CDP=Cresyl diphenyl phosphate.

*Appearance: A=Light colored, no precipitate; B=Dark colored, no precipitate; C=Dark colored, precipitate D=Catastrophic failure.

*ΔTAN: Change in total acid number.

TABLE 3

| COMPOSITION | 72 Hours at 204°C KINEMATIC VISCOSITY (100°F) INITIAL | FINAL | %CHANGE | ACID NUMBER (mg KOH/g) INITIAL | FINAL | ΔTAN |
|---|---|---|---|---|---|---|
| Ex. 1(b) | 21.17 | 22.04 | +4.10 | 0.05 | 3.09 | 3.04 |
| Ex. 1(a) | 31.99 | 32.07 | +0.25 | 0.06 | 1.34 | 1.28 |
| Ex. 1(d) | 48.08 | 50.69 | +5.42 | 0.11 | 3.84 | 3.73 |
| IPP* | 32.04 | 34,560 | +107,765.0 | 0.05 | 125.13 | 125.60 |
| TCP* | 27.41 | 3,860 | +13,982.0 | 0.02 | 125.62 | 125.60 |
| CDP* | 18.79 | 840 | +4,370.5 | 0.05 | 80.97 | 80.92 |

*same as Table 2.

TABLE 4

| COMPOSITION | 72 Hours at 218°C KINEMATIC VISCOSITY (100°F) INITIAL | FINAL | %CHANGE | ACID NUMBER (mg KOH/g) INITIAL | FINAL | ΔTAN |
|---|---|---|---|---|---|---|
| Ex. 1(b) | 21.17 | 22.55 | +6.52 | 0.05 | 4.93 | 4.88 |
| Ex. 1(a) | 31.99 | 33.13 | +3.56 | 0.06 | 3.32 | 3.26 |
| IPP* | 32.04 | 527.00 | +1,544.80 | 0.05 | 89.79 | 89.74 |
| TCP* | 27.41 | 890.00 | +3,146.00 | 0.02 | 105+ | 105+ |
| CDP* | 18.79 | 63.31 | +237.00 | 0.05 | 60.50 | 60.45 |

*Same as Table 2.

TABLE 5

| COMPOSITION | TIME (HOURS) | TEMP°C | KINEMATIC VISCOSITY (100°F) INITIAL | FINAL | % CHANGE |
|---|---|---|---|---|---|
| Ex. 1(a) | 72 | 175 | 31.99 | 32.15 | 0.50 |
| Ex. 1(a)-A | 72 | 175 | 31.79 | 32.09 | 0.94 |
| Ex. 1(a)-B | 168 | 175 | 33.10 | 33.10 | 8.70 |
| Ex. 1(a)-C | 72 | 175 | — | — | — |
| Ex. 1(a)-D | 72 | 175 | 41.57 | 41.77 | 0.48 |

Ex. 1(a)-A contains 0.1% Sarkosyl O, 0.01% benzotriazole, 1% diphenylamine (DPA) and 0.001% silicone (dimethyl silicone fluid)antifoam.
Ex. 1(a)-B is formulated with 1% phenyl α-naphthylamine, 0.01% benzotriazole, 0.5% Kronox S, 0.025% Ortholeum 162 and 0.001% silicone antifoam.
Ex. 1(a)-C contains of 0.01% benzotriazole, 1% DPA, 0.025% Ortholeum 162 and 0.001% silicone antifoam. Only ASTM D-665 tests were made.
Ex. 1(a)-D contains 0.01% benzotriazole, 0.01% Ortholeum 162 and 0.001% silicone antifoam agent.
Sarkosyl O - trademark for N-oleoyl sarcosine free acid, a rust and corrosion inhibitor.
Kronox S - trademark for epoxidized soybean oil.
Ortholeum 162 - trademark for mixed mono- and dialkyl phosphate, the alkyl groups being $C_8$–$C_{12}$.

TABLE 6

| COMPOSITION | ACID NUMBER (mg KOH/g) INITIAL | FINAL | ΔTAN | mg/cm² Cu | Steel | Mg | Al | Ag | Rust Preventing Characteristic ASTM D-665 A | B |
|---|---|---|---|---|---|---|---|---|---|---|
| Ex. 1(a) | 0.18 | 0.18 | 0 A | −0.33 | 0.00 | −0.04 | 0.00 | 0.00 | | F |
| Ex. 1(a)-A | 0.41 | 0.59 | 0.18 A | +0.07 | +0.02 | +0.03 | +0.01 | +0.01 | | P |
| Ex. 1(a)-B | 0.27 | 1.20 | 0.93 A/B | +0.01 | +0.02 | +0.01 | +0.01 | +0.00 | | F |
| Ex. 1(a)-C | — | — | — | — | — | — | — | — | P | P |
| Ex. 1(a)-D | 0.21 | 1.12 | 0.91 A | −0.08 | 0.00 | 0.00 | 0.00 | −0.03 | P | P |

Ex. 1(a)-A contains 0.1% Sarkosyl O, 0.01% benzotriazole, 1% diphenylamine (DPA) and 0.001% silicone (dimethyl silicone fluids) antifoam.
Ex. 1(a)-B is formulated with 1% phenyl α-naphthylamine, 0.01% benzotriazole, 0.5% Kronox S, 0.025% Ortholeum 162 and 0.001% silicone antifoam.
Ex. 1(a)-C contains of 0.01% benzotriazole, 1% DPA, 0.025% Ortholeum 162 and 0.001% silicone antifoam. Only ASTM D-665 tests were made.
Ex. 1(a)-D contains 0.01% benzotriazole, 0.01% Ortholeum 162 and 0.001% silicone antifoam agent.
Sarkosyl O - trademark for N-oleoyl sarcosine free acid, a rust and corrosion inhibitor.
Kronox S - trademark for epoxidized soybean oil.
Ortholeum 162 - trademark for mixed mono- and dialkyl phosphate, the alkyl groups being $C_8$–$C_{12}$.
Note:
Temperatures and times of exposure are the same as Table 5.

What is claimed is:

1. Functional fluid compositions comprising, as the base stock, 95 to 99.99 percent by weight of a mixed liquid tertiary-butylphenyl/phenyl phosphate containing from about 15 to 60 percent by weight mono- and di-t-butylphenyl radicals, and in admixture with the base stock about 0.01 to 5 percent by weight of a lubricant additive.

2. The composition of claim 1 where the lubricant additive is a rust inhibitor, corrosion inhibitor, antifoam agent, cavitation inhibitor or anti-wear agent.

3. The composition of claim 1, characterized as having a kinematic viscosity stability of ±5 percent when subjected to temperatures in the range of about 175° to 220°C. for a period of about 72 hours.

4. The composition of claim 1 wherein the fluid contains 0.01 to 0.1 percent benzotriazole as the additive.

5. The composition of claim 1 when the fluid contains 0.01 to 0.1 percent N-oleoyl sarcosine as the additive.

6. The composition of claim 1 where the fluid contains 0.01 to 0.1 percent of a mixed mono- and dialkyl phosphate as the additive, the alkyl being about 8 to 12 carbon atoms.

7. The composition of claim 1 where the fluid contains 0.01% benzotriazole, 0.01% of a mixed $C_8$–$C_{12}$ mono- and dialkyl phosphate and 0.001% of a silicone antifoam agent.

8. Mixed functional fluid compositions comprising (a) 10 to 90 percent by weight of a mixed liquid tertiary-butylphenyl/phenyl phosphate, containing from about 15 to 60 percent by weight mono- and di-t-butylphenyl radicals and (b) 90 to 10 percent by weight of another fluid composition useful in formulating functional fluids.

9. The composition of claim 8 where said other fluid composition is selected from the group consisting of synthetic and natural hydrocarbon oils, halogenated aromatic hydrocarbons, alkanoic acid esters of polyhydroxy organic compounds, alkoxy polysiloxanes, organo polysiloxanes, methyl alkyl silicone fluids, siloxane esters, polyphenyl ethers, polyglycols and silicate esters.

10. The composition of claim 8 wherein there is present from 60 to 40 percent by weight of said t-butylphenyl/phenyl phosphate.

11. The composition of claim 8 where said other fluid composition is a pentaerythritol, trimethylolethane, trimethylol propane or neopentyl glycol ester of a $C_5$ to $C_{10}$ alkanoic acid.

12. The method of lubricating metallic surfaces at elevated temperatures comprising applying to said surfaces a liquid phosphate ester lubricant consisting essentially of a liquid mixed t-butylphenyl/phenyl phosphate containing from about 15 to 60 percent by weight mono- and di-t-butylphenyl radicals.

13. The method of claim 12 wherein said metallic surfaces are turbine bearings and gears.

14. The method of claim 12 where the temperature is in excess of 175°C.

* * * * *

UNITED STATES PATENT OFFICE

CERTIFICATE OF CORRECTION

PATENT NO. : 3,931,023

DATED : January 6, 1976

INVENTOR(S) : Harry Dounchis

It is certified that error appears in the above-identified patent and that said Letters Patent are hereby corrected as shown below:

Column 2, line 45, "tetraryl" should read --tetraaryl--

Column 2, line 47, "fluids" should read --fluid--

Column 3, line 21, "exhibit anti-wear" should read --exhibit good anti-wear--

Column 3, line 63, "13.0) moles began" should read --13.0 moles) began--.

Column 5, Table 1, "(mmKOH/g)" should read --(mm/KOH/g)--

Column 5, Table 2, "(mg KOH/g)" should read -- (mg/KOH/g)--

UNITED STATES PATENT OFFICE

CERTIFICATE OF CORRECTION

PATENT NO. : 3,931,023

DATED : January 6, 1976

INVENTOR(S) : Harry Dounchis

It is certified that error appears in the above-identified patent and that said Letters Patent are hereby corrected as shown below:

Column 5, Table 2, "FINAL % INITIAL FINAL CHANGE FTAN*" should read --FINAL % CHANGE INITIAL FINAL ΔTAN*--

Column 5, Table 2, "precipitate D" should read --precipitate;D--

Column 7, Table 3, "(mg KOH/g)" should read --(mg/KOH/g)--

Column 7, Table 5, "TIME (HOUR-S) TEMP°C" should read --TIME (HOUR-S) TEMP°C--

Column 7, Tables 5 and 6, footnotes "contains of 0.01%" should read --contains 0.01%--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*